United States Patent [19]

Schnelker

[11] Patent Number: 4,913,213

[45] Date of Patent: Apr. 3, 1990

[54] PLEATED BLIND BETWEEN WINDOW PANES

[75] Inventor: James B. Schnelker, Pella, Iowa

[73] Assignee: Rolscreen Company, Pella, Iowa

[21] Appl. No.: 135,976

[22] Filed: Dec. 21, 1987

[51] Int. Cl.[4] ..... E06B 9/307

[52] U.S. Cl. ..... 160/107

[58] Field of Search ..... 160/107, 172; 411/395

[56] References Cited

U.S. PATENT DOCUMENTS

| | | | |
|---|---|---|---|
| 2,557,978 | 6/1951 | Krumm | 160/107 X |
| 2,976,583 | 3/1961 | McCarthy . | |
| 3,008,196 | 11/1961 | Springer et al. . | |
| 3,318,360 | 5/1967 | Persson | 160/107 |
| 3,342,243 | 9/1967 | Salter . | |
| 3,389,737 | 6/1968 | Arnold et al. . | |
| 4,203,264 | 5/1980 | Kiefer et al. . | |
| 4,274,469 | 6/1981 | Kuyper et al. | 160/107 |
| 4,347,835 | 9/1982 | Seemann . | |
| 4,432,174 | 2/1984 | Grether et al. . | |
| 4,459,778 | 7/1984 | Ball . | |
| 4,613,530 | 9/1986 | Hood et al. . | |
| 4,664,169 | 5/1987 | Osaka et al. . | |

FOREIGN PATENT DOCUMENTS

| | | | |
|---|---|---|---|
| 103853 | 2/1964 | Norway | 160/107 |

*Primary Examiner*—Blair M. Johnson

*Attorney, Agent, or Firm*—Zarley, McKee, Thomte, Voorhees & Sease

[57] ABSTRACT

A double glazing panel including a pleated blind within, and means for raising and lowering the blind. One embodiment includes an aperture in one of the glazing panels, a bolt with a hole through the center mounted in the aperture, and the blind control means passing through the bolt hole and further up and over a screen, if desired. Another embodiment provides routing the control means over the glazing housing, and any screen housing provided. The blind may be optionally mounted to one of the glazing panels to aid in cleaning.

20 Claims, 3 Drawing Sheets

PLETED BLIND BETWEEN WINDOW PANES

BACKGROUND OF THE INVENTION

Double glazing windows provide for improved insulation from outside elements. Further advantages are achieved when a means may be placed between the glazing to provide for selective shading.

A prior device has provided for a slat blind positioned between the glazing with an adjusting device mounted so that the slats of the blind may be adjusted while maintaining the window seal. However, it is not shown to provide for a pleated blind positioned between the panes of glass, nor for a mechanism for raising and lowering the pleated blind while maintaining the window seal. Pleated blinds, unlike slat blinds, are constructed of one continuous piece of material which is pleated so that it may be folded as it is raised. Pleated blinds are sometimes preferred in that they may be raised out of sight. A wide range of material is available for pleated blinds which can include softer fabrics.

In addition, it has been found to be advantageous to provide for a method of mounting blinds by attaching the mounting bracket to one of the panels of glass, in order to ease cleaning.

The present invention provides for a sealed double glazing window with a pleated blind positioned between the panes of glass and a means for raising and lowering the blinds in an efficient manner while maintaining the window seal.

Accordingly, it is an object of this invention too provide for a double glazing window which includes a pleated blind between the two panes of glass.

One object is to provide operation of the blind to occur independently of the window operation.

Another object of the invention is to provide for routing the control means of the blind from between the panes of glass to the interior side of the window so that the blinds may be adjusted while maintaining the window seal.

A further object of the invention is to provide for an aperture in one of the panes of glass, a bolt with a hole through the center placed in this aperture, and a control means routed from between the panes of glass to the interior side of the window.

Yet another object of the invention is to further provide for routing of the control means over the housing for a screen located on the interior side of the window.

A further object of the invention is to provide for the means to hold the blind in position to be directly mounted to one of the panes of glass to ease in cleaning.

SUMMARY OF THE INVENTION

This invention relates to a pleated blind which is placed between two panes of glass in a window and which can be opened or shut while maintaining the window seal. Several routes for this control means are provided, including passing the control means over the housing which holds the inside pane of glass or also routing the control means over the housing for a screen. Another embodiment provides for including an aperture through the inside pane of glass, and placing in this aperture a bolt which has a hole through it, and then passing the control means through the hole in the bolt. As with the first embodiment, the control means may be further routed up and over the housing of the screen between the blind and the interior of the room. Further, the means for holding the blind in place may be either attached to the head of the sash, or directly attached to the removable inside pane of glass. The control means may be a cord which is routed through the bolt which holds the blind to the removable pane of glass.

DETAILED DESCRIPTION OF THE INVENTION

Figure 1:
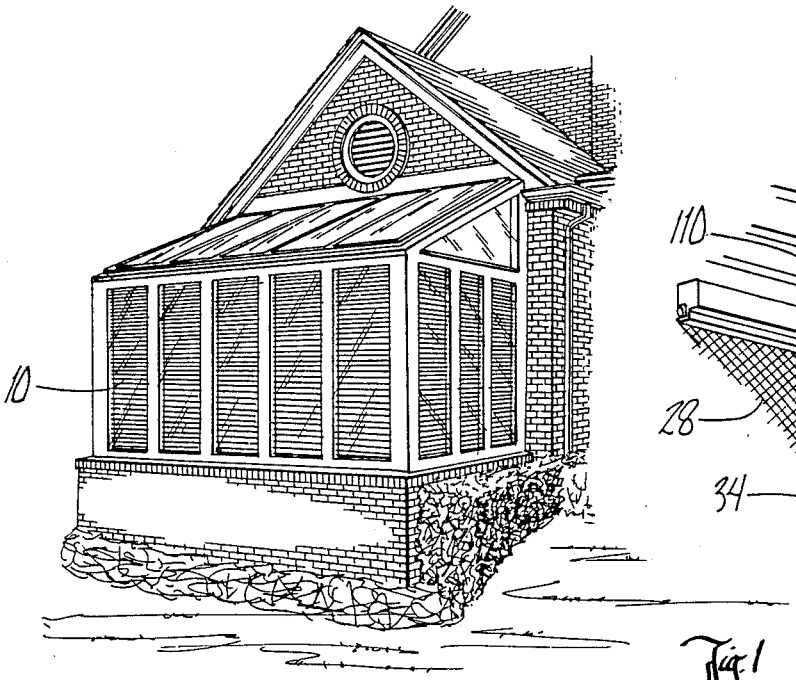
FIG. 1 is a fragmentary perspective view of a house in which the window of the invention has been mounted.
Figure 4:
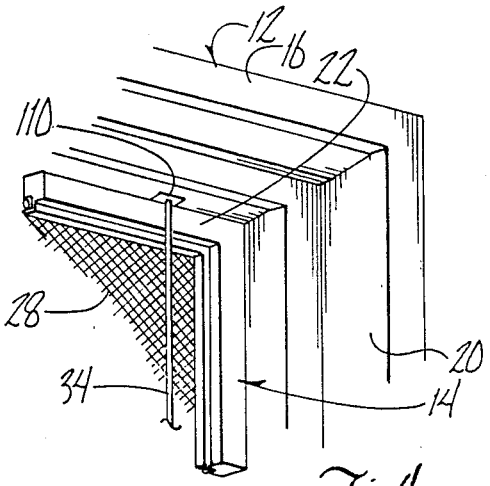
FIG. 4 is a view similar to FIG. 3 but showing the screen in place.
Figure 2:
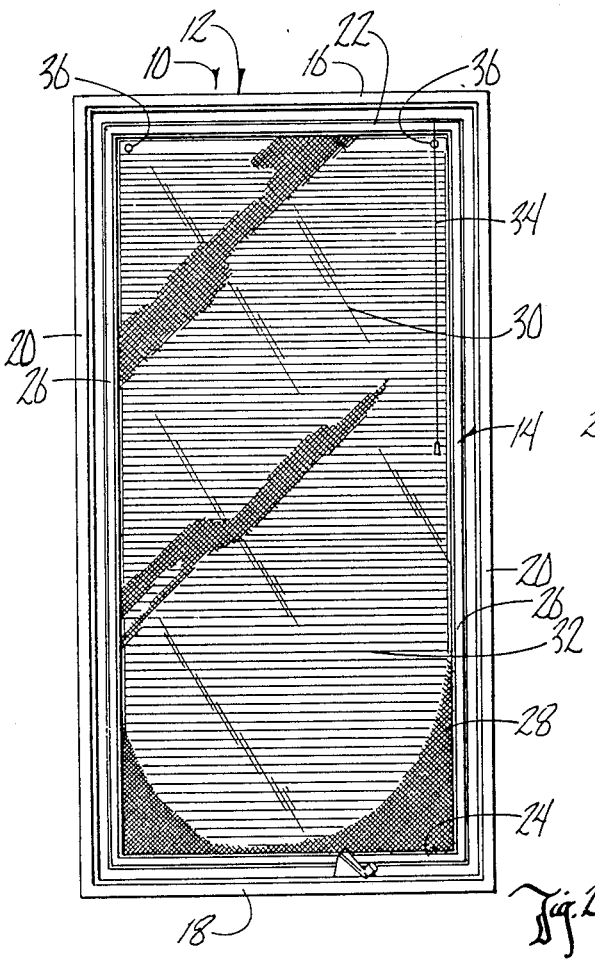
FIG. 2 is a front elevational view of a window including the invention.
Figure 3:
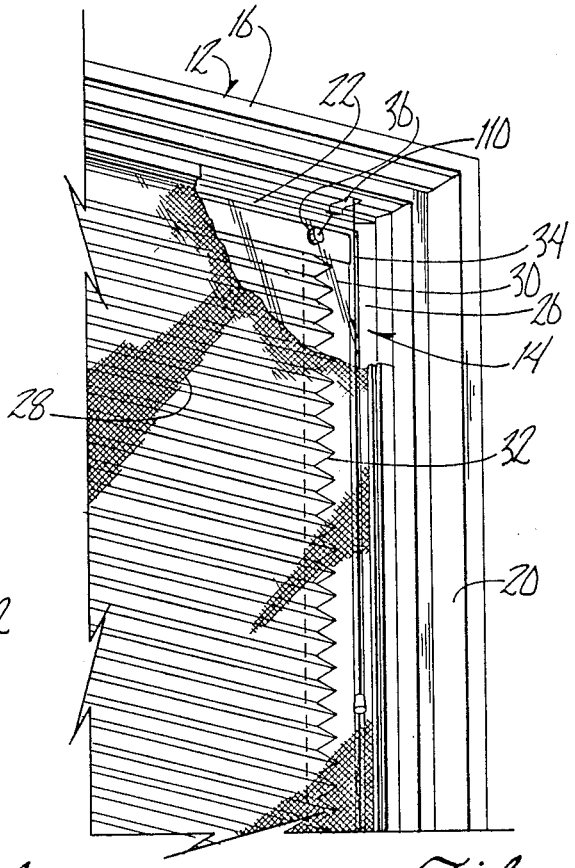
FIG. 3 is a fragmentary perspective view of the window, with part of the screen broken away to display one embodiment of the invention.
Figure 5:
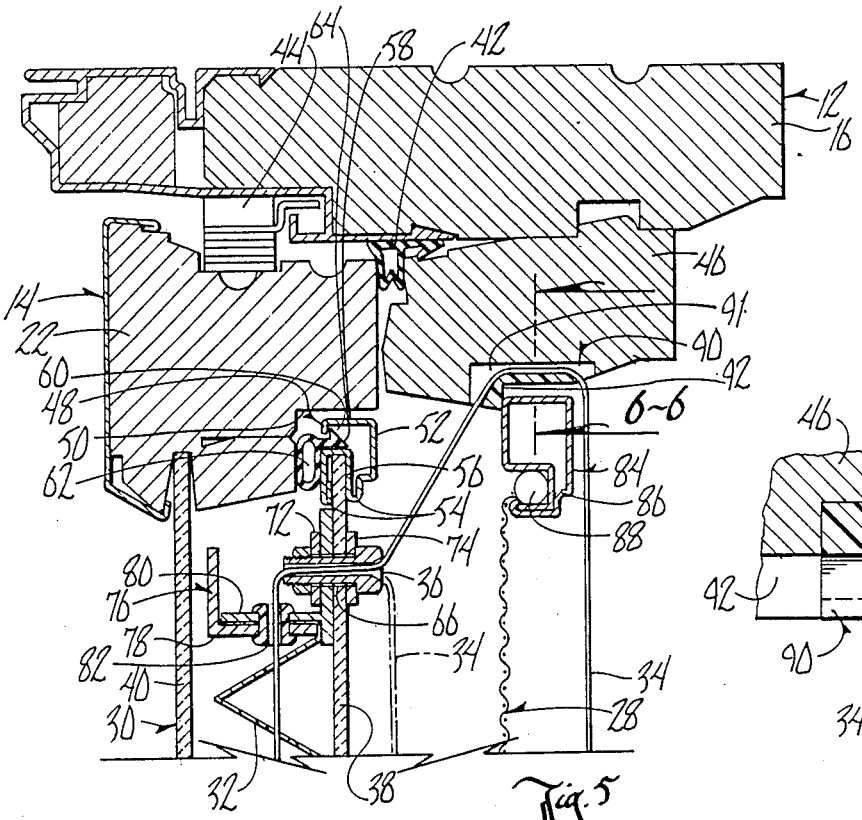
FIG. 5 is a cross-sectional view showing the first embodiment of the invention.

FIG. 1 shows the widow 10 mounted in the wall of a house. The window 10 includes a frame 12 and a sash 14. The frame 12 includes a frame head 16, a frame sill 18, and frame jambs 20. The sash includes a sash head 22, a sash sill 24, and sash jambs 26. The screen on the interior of the window is shown at 28. The window 10 includes double glazing panels 30 mounted within the sash 14. Pleated blinds 32 are placed between the double glazing window panels 30. The control means in this embodiment of the invention which raises and lowers the pleated blinds is an actuator cord 34.

In FIGS. 2–7, a first embodiment of the invention is shown. A bolt 36 is located in the inner glazing panel 38 of the double glazing 30 with the actuator cord 34 shown routed through the bolt 36, above the screen 28 to the interior of the window 10. The bolt is plastic or low friction material The inner glazing panel is represented at 38 and the outer glazing panel at 40. The inner panel 38 is removable while the outer panel 30 is fixed. The frame head 16 has below it a weather seal 42 and a pivot pin 44. A stop 46 aids in preventing inward movement of the sash 14. Interior glazing housing is generally represented at 48. This housing 48 surrounds the inner glazing panel 38. An L-shaped stop 50 is part of sash 14. Placed adjacent to this L-shaped stop 50 is a frame 52 containing flanges 54 to create a glazing receiving slot 56 into which the inner glazing panel 38 is placed. The frame 52 also contains an upper vent portion 58 providing for slot 60. A gasket 62 abuts the L-shaped stop 50, and the gasket 62 includes a hooked portion 64. The hooked portion 64 fits within the slot 60 created by the upper bent portion 58 of the frame 52. The inner glazing panel 38 contains an aperture 66. Contained within the aperture 66 is the bolt 36 which includes threads 68 and a hole through the center of the bolt 70. An outside washer is provided at 72 and an inside washer at 74.

The pleated blind 32 is held in place by a bracket 76 which is directly mounted to the removable inner glazing panel 38. The bracket includes an L-shaped portion 78 and a T-shaped portion 80, which is attached directly to the inner glazing 38 and held in place by the outside washer 72 of bolt 36. L-shaped portion 76 has the additional aesthetic advantage of blocking the view of bolt 36 and surrounding area from the outside. Through the center of the bracket 76 is provided a grommet 82 through which the actuator cord 34 may pass. In this manner, the actuator cord 34 passes through the grommet 82, through the bolt hold 70 to the interior side of the window 10 as shown at 34 in solid and dash lines.

Figure 6:
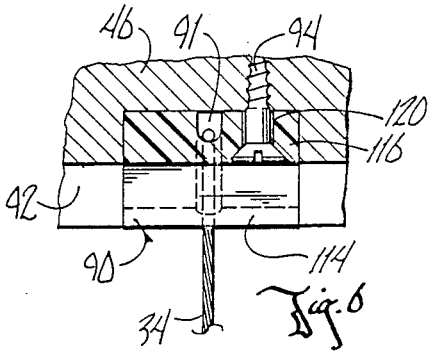
FIG. 6 is a cross-sectional view taken along line 6—6 in FIG. 5 showing detail of a portion of the first embodiment.

Some windows will also provide for a screen 28 inside the window 10. In this adaptation, the screen housing is generally represented at 84. The housing 84 includes a screen frame 86 which creates a slot into which the screen 28 is held in place by rubber tubing 88. Above housing 84, a screen bypass guide 90 (FIG. 5) is installed in stop 46. This guide is preferably made of plastic or low friction metal, to aid in movement of the actuator cord 34. The screen guide 90 is held in place by a screw 120. When a screen is provided for, the actuator cord 34, after passing through bolt hole 70, is further routed up over the screen housing 84, and through the screen by-pass guide 90. FIG. 6 shows a cross-sectional view of the guide 90, actuator cord 34, and the screw 94 which holds the screen guide 90 in place. The screw 94 is also placed off to one side of an L-shaped cord channel 91.

Figure 7:
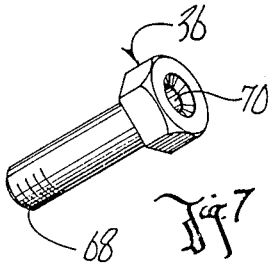
FIG. 7 is a perspective view which shows the details of the bolt.

FIG. 7 shows details of the bolt 38, including the threading 68, and the bolt hole 70.

In this manner, the actuator cord 34 connected to the blinds, passes through the bolt hole to the inside, and allows for control of the pleated blind while maintaining the window seal. The low friction material of the by-pass screen guide 90, assists in smooth movement of the actuator cord 34 to raise and lower the pleated blinds 32. Further, by providing for the pleated blind to be mounted by a bracket directly to one of the glazing panels, ease in cleaning is provided for, by simply removing the glass panel supporting the pleated blind. This adaptation of providing for the blind to be directly mounted to one of the glazing panels need not be limited to use with pleated blinds, but also may be used with slat blinds, such as the Slim Shade® manufactured by Rolscreen Co., Pella, Iowa. It is to be understood that the routing mechanism may be used with or without a screen, and need not be used in combination with the bracket mounted to the glazing panel in order to fall within the ambit of the invention.

Figure 8:
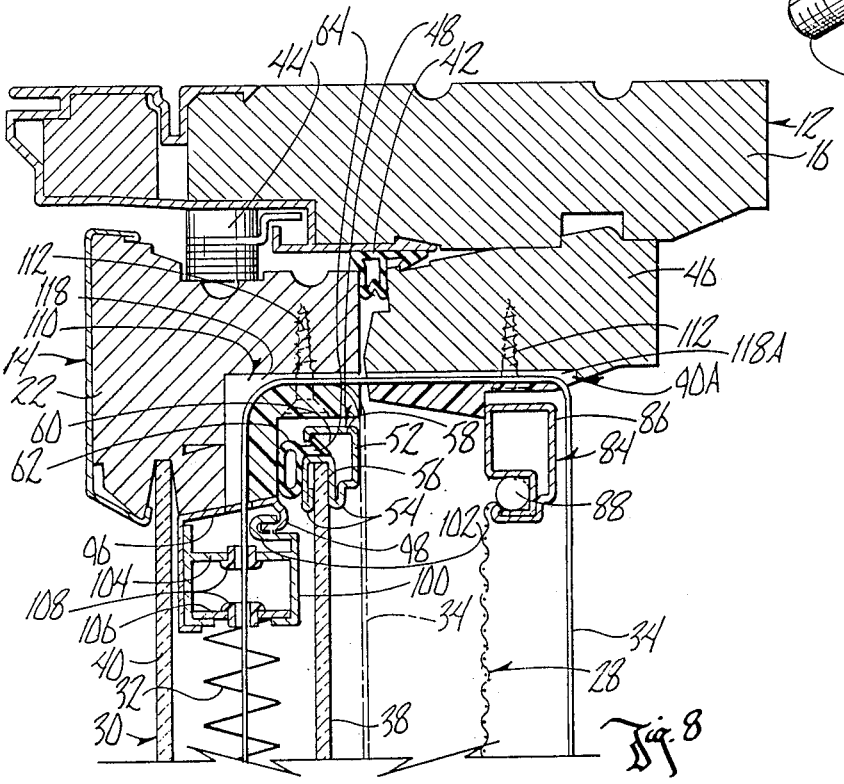
FIG. 8 is a cross-sectional view showing the second embodiment of the invention.

FIG. 8 shows a second embodiment of the invention. A different means of holding the pleated blind 32 in position is demonstrated and a two-part guide is provided for actuator cord 34. A mounting clip 96 is directly mounted to the sash 22. The clip 96 includes a hook portion 98. A head rail 100 takes the place of the bracket 76 of FIG. 5, and includes a curved portion 102, an upper support 104, and a lower support 106. The curved portion 102 allows the head rail 100 to be clipped onto the mounting clip 96 by placing the curved portion 11002 within the hook 98. Grommets 108 are provided in both the upper support 104 and the lower support 106. The head rail 100 may be either mounted upon the mounting clip 96, or directly mounted to one of the glazing panels. This embodiment provides for the actuator cord 34 to be routed up and over the inner glazing panel 38 by passing it around an L-shaped sash by-pass guide 110. This sash by-pass guide 110, like the screen guide 90, is also made of plastic or friction resistant material to aid in moving the actuator cord 34. The actuator cord 34 then drops down in front of the window 10 as seen at 34 in the dash line position. When a screen 28 is used, the cord is further routed over a screen guide 90A and will fall in front of the screen as shown in FIG. 8. The screen guide 90A in this case will need to be of a more elongated material in order to prevent the actuator cord 34 from dropping down between the screen 22 and inner glazing 38. Both the screen guide 90A and the sash guide 110 are held in place by screws 112 offset from the path of the actuator cord 34 (FIGS. 9–12). Whether used with or without a screen, the inner glazing panel 38 may be removed and cleaned without disturbing the blind 32.

Figure 9:
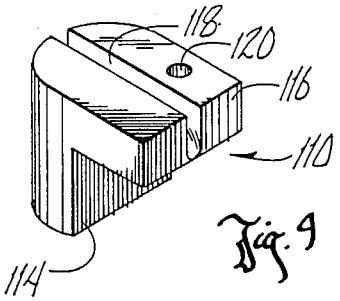
FIG. 9 is a front perspective view of the sash guide of the invention.
Figure 10:
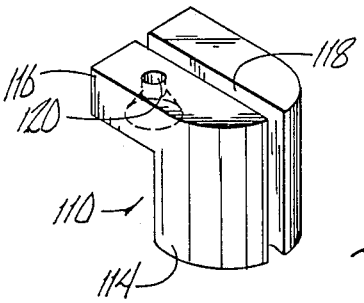
FIG. 10 is a rear perspective view of the sash guide of the invention.
Figure 11:
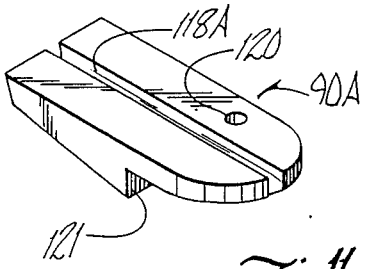
FIG. 11 is a front perspective view of the screen guide of the invention.
Figure 12:
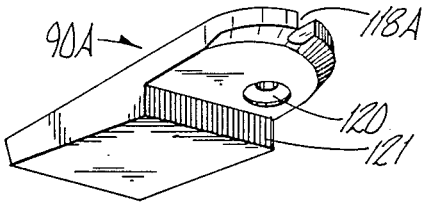
FIG. 12 is a bottom perspective view of the screen guide of the invention.

Details of the sash guide 110 and the screen guide 90A are shown in FIG. 9–12. FIGS. 9 and 10 show the sash guide 110. A lower portion at 114 of the sash guide 110 and an upper portion 116 include within an L-shaped channel 118. The actuator cord 34 passes through and is guided by channel 118. Offset from channel 118 is a screw hole 120 used to mount the sash guide 110 to the sash 22. FIGS. 11 and 12 show the elongated screen guide 90A of FIG. 8. It includes a channel 118A for guiding the actuator cord and a screw hole 120 offset from the channel 118A in order to attach the screen guide 90A to the sash head 22. Stop 121 abuts screen housing 84. The screen guide 90A of this embodiment (FIG. 8) is more elongated than the guide 90 of the first embodiment FIG. 5 since actuator cord 34 passes up and over the housing for inner glazing panel 38.

Therefore, it can be seen from the preferred embodiment of the invention that a pleated blind between double glazing panels is provided with control means to aid in the ease of manipulating the pleated blinds, and means to aid cleaning of blinds and glazing.

What is claimed is:

1. A sealed double glazing window having an interior side and an exterior side comprising:

two spaced panes of glass seated in a frame;

a blind positioned within said space having a cord control means for raising and lowering said blind;

one of said panes of glass having an aperture therethrough;

a bolt having a hole through the center placed in said aperture;

said cord control means extending through said hole of said bolt to the interior side of said window wherein said control means may be used to raise and lower said blind while maintaining the window seal.

2. The window of claim 1 wherein said blind is a pleated blind.

3. The structure of claim 1 including a screen seated in the frame on the interior side of said window; said screen including a screen housing supporting said screen; said control means cord being further routed over said screen and screen housing to the interior side of said window and said screen.

4. The structure of claim 3 further comprising a guide means secured to said frame and positioned over said screen and providing a passageway over said screen; said actuator cord routed in said passageway over said screen by sliding engagement with said guide.

5. The structure of claim 4 wherein said guide means consists of friction resistant material and includes an upper horizontal channeled portion and a lower vertical channeled portion extending downward from said upper portion towards said bolt to assist in guiding said actuator cord over said screen.

6. The structure of claim 5 wherein said guide is secured to said frame by a screw.

7. The structure of claim 1 wherein said blind is mounted by securing means to said one pane of glass and said one pane of glass is removable from the interior side whereby when said one pane is removed, said blind is carried with said one pane.

8. The structure of claim 7 wherein said bolt is further defined as being the securing means for mounting said blind on said one pane.

9. The structure of claim 7 including a screen seated in the frame on the interior side of said window; said screen including a screen housing supporting said screen; said control means cord being further routed over said screen and screen housing to the interior side of said window and said screen.

10. The structure of claim 8 including a screen seated in the frame on the interior side of said window; said screen including a screen housing supporting said screen; said control cord means being further routed over said screen and screen housing to the interior side of said window and said screen.

11. The structure of claim 7 wherein said blind has interior and exterior sides and a bracket is connected to the top of said blind and has vertical interior and exterior portions, said vertical interior portion being connected by said securing means to said one pane of glass and said vertical exterior portion being directly behind said interior portion and connecting means thereby obscuring said connecting means from view from the exterior.

12. The structure of claim 5 wherein said screen housing has top, bottom, and interior and exterior sides, and said guide means is positioned on the top and exterior sides of said housing with said upper horizontal channeled portion extending along the top side between the exterior and interior sides and said lower vertical channeled portion extending along the exterior side of said housing.

13. The structure of claim 1 wherein said frame has top, bottom and side edges and said aperture in said one pane is located closely adjacent said frame top edge and one side edge.

14. A sealed double glazing window having an interior side and an exterior side comprising:

interior and exterior spaced panes of glass sealed in a frame having a top side, a blind positioned in said space having control means for raising and lowering said blind;

said control means extending from the interior side of said window to in between said panes of glass for operating said blind while maintaining the window seal, said frame including a housing for said interior pane of glass; said control means including a cord being routed from said blind over said housing to the interior side of said window, and an interior pane guide means positioned in said frame top side and having an upper horizontal channel portion and a lower vertical channeled portion extending downward from said upper portion toward said blind, said horizontal portion engaging and extending over said housing and said vertical portion engaging and extending downwardly along the adjacent side of said housing.

15. The structure of claim 14 including a screen seated in the frame on the interior side of said window; said screen including a screen housing supporting said screen; said control means cord being further routed over said screen and screen housing to the interior side of said window and said screen.

16. The structure of claim 15 wherein said window further includes a screen seated in the frame on the interior side of said window; said screen including screen housing supporting said screen, said cord being further routed over said screen and screen housing to the interior side of said window and said screen, a screen guide means mounted in said frame and positioned over and engaging said screen housing and providing a passageway over said screen for said cord routed in said passageway, said channel of said horizontal portion of said interior pane guide means being in alignment with the passageway of said screen guide means to provide a substantially uninterrupted support for said cord between said space between said interior and exterior panes to the interior side of said interior pane.

17. A double glazing window having interior and exterior sides comprising:

interior and exterior spaced panes of glass seated in a frame, a blind positioned within said space having control cord for operating said blind and said cord control means being routed from said blind to the interior side of said window, and said blind being mounted on said interior pane of glass and said interior pane of glass being removable from said frame carrying said blind with it.

18. The structure of claim 17 wherein said cord routed to the interior side of said window is further defined as being routed through an opening in said interior pane of glass.

19. The structure of claim 18 wherein said blind mounted on said interior pane of glass is further defined as being mounted by bolt means and said bolt means includes an opening extending therethrough through which said cord is routed to the interior side of said window.

20. A sealed double glazing window having an interior side and an exterior side comprising:

two spaced panes of glass seated in a frame;

a blind positioned within said space having a control cord for operating said blind;

one of said panes of glass having an aperture therethrough;

a bolt having a hole through the center placed in said aperture;

said control cord extending through said hole of said bolt to the interior side of said window wherein said control cord may be used to operate said blind while maintaining the window seal.

* * * * *